United States Patent [19]

Isenberg, Jr.

[11] B 3,996,875

[45] Dec. 14, 1976

[54] INTEGRAL HYDRAULIC PUMP AND WHEEL STEERING MECHANISM FOR SAILBOATS

[76] Inventor: Martens Isenberg, Jr., 23 Cypress Ave., Glen Head, N.Y. 11545

[22] Filed: Dec. 4, 1974

[21] Appl. No.: 529,659

[44] Published under the second Trial Voluntary Protest Program on February 24, 1976 as document No. B 529,659.

[52] U.S. Cl. ..... 114/144 R; 114/109; 114/130

[51] Int. Cl.[2] ..... B63H 25/00; B63B 41/00

[58] Field of Search ..... 114/144 R, 128, 131–139, 114/141, 109, 210; 180/78, 77 R, 77 S, 77 H, 77 HT

[56] References Cited

UNITED STATES PATENTS

| | | | |
|---|---|---|---|
| 667,158 | 1/1901 | Webster | 114/138 |
| 1,101,692 | 6/1914 | Goodspeed | 180/77 R |
| 1,799,257 | 4/1931 | Schauman | 114/210 |
| 2,121,894 | 6/1938 | Torjussen | 114/144 R |
| 3,620,182 | 11/1971 | Russell | 114/109 |

*Primary Examiner*—Trygve M. Blix
*Assistant Examiner*—Sherman D. Basinger
*Attorney, Agent, or Firm*—Burgess, Dinklage & Sprung

[57] ABSTRACT

An improvement in a steering assembly for navigating a boat, such as a sailboat, having a vertically movable centerboard and/or an adjustable backstay either or both of which are movable by a hydraulic means including a hydraulic pump whereby to raise or lower the centerboard and/or rake the mast attached to the backstay, the boat having a steering wheel connected to a hollow steering wheel shaft which shaft in turn is connected to a steering sprocket. The improvement resides in means for simultaneously either (a) raising or lowering the centerboard or (b) adjusting the tension on the backstay and steering which means comprises a hydraulic pump shaft connected to a hydraulic pump, said pump shaft disposed through the hollow steering wheel shaft, said shaft terminating at the steering wheel where it is connected to an actuating means.

10 Claims, 3 Drawing Figures

HYDRAULIC FLUID TO/FROM CENTERBOARD RAISE-LOWER CONTROL CYLINDER OR BACKSTAY ADJUSTER
TWO-POSITION Y VALVE WITH COMMON HANDLE
CENTERBOARD PISTON
BACKSTAY PISTON

INTEGRAL HYDRAULIC PUMP AND WHEEL STEERING MECHANISM FOR SAILBOATS

BACKGROUND OF THE INVENTION

1. Field of the Invention

This invention relates to a navigation means for nautical vessels and particularly to means for insuring maximum navigational control of a sailboat. This invention is directed to an assembly which facilitates the steering of a sailboat while allowing a single operator to (a) raise or lower a centerboard or (b) adjust the backstay to change the tension thereof whereby to rake the mast. This invention is, therefore, a unitary navigational means of insuring maximum control over nautical vessels equipped with a vertically movable centerboard and/or an adjustable backstay.

2. Discussion of the Prior Art

In the sport of sailing it is known to operate the rudder by a remotely disposed steering wheel connected to a steering wheel shaft which shaft is rotatable and connected ultimately to the rudder itself. It is also known to utilize a hydraulic means to raise or lower the centerboard and/or adjust the backstay. The raising or lowering of the centerboard allows the sailor to sail closer into the wind with minimum side slip. The sailor will raise the centerboard when the vessel approaches the shallow water or when sailing downwind. When the vessel departs for the open and deeper waters the centerboard is lowered hydraulically to insure maximum stabilization of the vessel.

It is also known when sailing into the wind to dispose the mast of the sailboat substantially vertical. However, when sailing with the wind with the sails extending outward from the boat it is desired to rake the mast, i.e., to incline it a short distance sternwise whereby to form a pocket in the sail to improve the efficient utilization of the wind. This operation is conducted by utilizing a backstay connected to the mast from the stern of the boat. By regulating tension thereon the mast can be inclined slightly sternwise, e.g., about 6 inches. Release of this tension allows the mast to return to the normal vertical position. In some sailboats the raking of the mast has been accomplished by use of a hydraulic piston which exerts a tension on the backstay. The piston actuation means has, however, been remotely located on the sailboat requiring the attention of a second member of the crew other than the person steering the boat.

Similarly, problems have been encountered in the operation of these vertically movable centerboards, particularly when the vessel approaches the shallow water. In the present state of the art the means for raising or lowering the centerboard has been physically disposed quite apart from the steering assembly. It will be appreciated that a significant amount of machinery is required to raise or lower centerboards in large vessels owing to the substantial weight that these centerboards have. Thus, the means for raising and lowering the centerboard or adjusting the backstay has been disposed at one portion of the boat quite apart from the steering wheel.

When the raising or lowering of the centerboard and/or adjusting the backstay is to be conducted the operator has had to ask another to assume the wheel of the boat while he proceeds to the point where the actuating means for the hydraulic pump of the raising and lowering or backstay system is positioned. When the backstay has been adjusted or the centerboard has been raised or lowered to the desired position he then returns to the wheel. Obviously, such an operation requires two people, both of whom must be quite skilled in sailing. This is not always possible, particularly in the sport of sailing where oftentimes only one member of a family is thoroughly familiar with the controls on the boat.

It, therefore, became desirable to provide a steering assembly equipped with means for raising and lowering the centerboard or adjusting the backstay where the actuating means for the backstay and centerboard raising and lowering assembly is positioned at the steering wheel. Obviously, such an assembly would permit for maximum navigational control and steering of the boat by permitting the boat to be steered with one hand while the centerboard was raised or lowered with the other or proper tension applied to the backstay. The employment of another individual on the boat is not required and full control of the raising and lowering operation and/or adjusting the backstay while steering of the boat is provided.

It is an object of this invention, therefore, to provide a navigational system for a nautical device especially one equipped with a vertically movable centerboard which can be raised or lowered or an adjustable backstay, either of which can be regulated in response to a hydraulic means. It is a particular object of the present invention to provide an assembly for raising or lowering the centerboard and/or adjusting the backstay of a nautical vessel which assembly is disposed at the steering wheel whereby actuation of the assembly can be done simultaneous with a steering apparatus by a single individual. Other objects and advantages of the present invention will become apparent from the ensuing disclosure.

SUMMARY OF THE INVENTION

Broadly, the present invention contemplates an improvement in a steering assembly for navigating a boat having a vertically movable centerboard or a backstay, movable by a hydraulic means including a hydraulic pump whereby to raise or lower the centerboard or adjust the backstay, said boat having a steering wheel connected to a hollow steering wheel shaft which shaft in turn is connected to a steering sprocket. The present invention resides in a means for simultaneously raising or lowering the centerboard or adjusting the backstay which means comprises a hydraulic pump shaft disposed through said steering wheel shaft, said hydraulic pump shaft connected to an actuating means at said steering wheel and, at its opposite end, connected to said hydraulic pump.

In a particularly desirable embodiment of the present invention there is provided a steering assembly in combination with a centerboard or backstay regulating assembly disposed about a single horizontal column. The assembly of the present invention utilizes a generally vertical steering wheel which is connected to a rotatable hollow steering wheel shaft which is mounted against a central sleeve member which itself is hollow and carries with the interior thereof a hydraulic pump shaft which acts as an actuating means for the hydraulic pump in the hydraulic lines employed to raise or lower the centerboard or adjust the backstay. Thus, the steering actuation is performed by a generally vertical revolution of the steering while the raising and/or lowering of the centerboard or backstay adjustment is effected by a horizontal displacement of the hydraulic pump shaft within that sleeve (and thus within the sleeve within the hollow steering wheel).

Before discussing particular embodiments of the invention it should be stated that the invention contains at least three embodiments as follows:

A. A combination steering assembly and centerboard raising and lowering assembly;

B. A combination steering assembly and backstay adjusting assembly; and

C. A combination steering assembly, centerboard raising and lowering assembly and backstay adjusting assembly.

The centerboard raising and lowering assembly and the backstay adjusting assembly are both actuated hydraulically. The essence of the invention is the disposition of either of the hydraulic pump handles in a hollow steering shaft. In fact, the use of a hollow steering shaft is a general innovation in nautical steering. It will be realized that either of the pump handles can be disposed in the hollow steering wheel shaft. In fact, a single pump handle can be disposed therein which is operative in respect of a single pump whose output can be controlled by a valve to actuate either the centerboard raising and lowering mechanisms or the backstay adjusting means depending on the setting of the valve. Thus, the invention covers alternative embodiments A and B as well as combination C.

BRIEF DESCRIPTION OF DRAWINGS

The present invention can be more readily understood and appreciated when reference is made to the accompanying drawings in which.

DESCRIPTION OF SPECIFIC EMBODIMENTS

Figures 1, 2, 3:
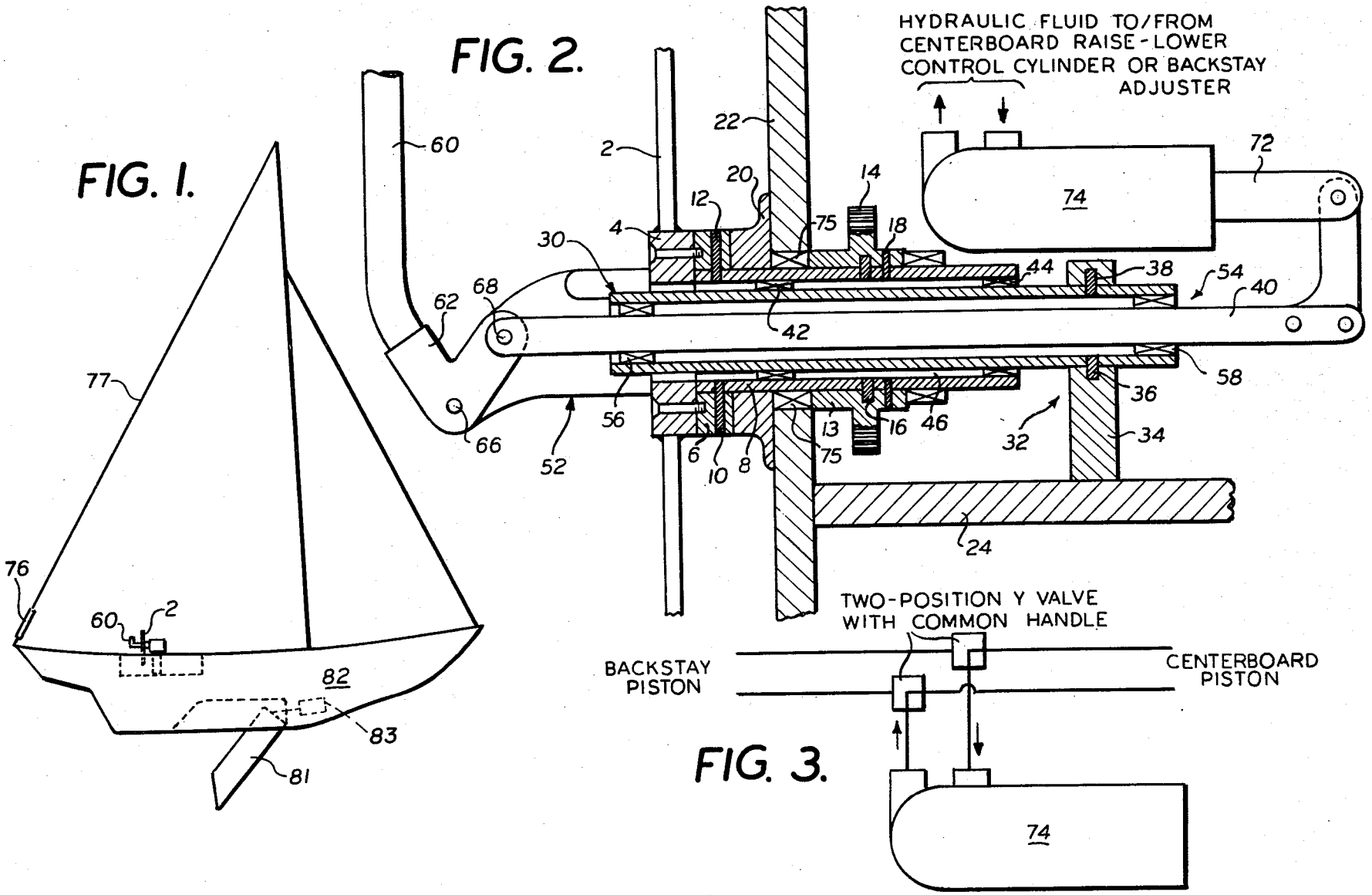
FIG. 1 is a side elevation of a sailboat in which the centerboard is shown in phantom to indicate that the centerboard can be raised or lowered or a hydraulic backstay adjuster may increase or decrease tension on the mast in response to the actuating means shown in FIG. 2.
FIG. 2 is a side elevation, partially in section of the nautical steering assembly of the present invention.
FIG. 3 is a schematic diagram of a hydraulic system which feeds hydraulic fluid to either a piston for the raising or lowering of the centerboard or to a piston which adjusts the backstay.

A specific embodiment of the present invention is shown in FIG. 2. The apparatus comprises a steering wheel 2 connected to a hub 4 in turn connected to a connector member 6 to which has been fastened a hollow steering wheel shaft 8 by use of a pair of screws 10 and 12. The hollow steering wheel shaft 8 is also connected to a plate 13 which in turn bears steering sprockets 14 by virtue of screws 16 and 18. The connecting member 6 bears in turn against a supporting member 20 which in turn rests upon a horizontal housing member 22 supported by a vertical housing member and support 24.

Within the hollow steering wheel shaft 8 there is disposed a central sleeve 30 which runs coaxially with the steering wheel shaft 8. Sleeve 30 extends above the vertical disposed hub member 4 and continues below the point of termination of the steering wheel shaft 8 as seen at 32. Sleeve 30 in turn is connected to a vertical support 34 via a pair of screws 36 and 38 which vertical support 34, in turn, is connected to horizontal support 24. This assembly assures that the sleeve 30 can properly act as a bearing point for the hollow steering wheel shaft 8 and the hydraulic pump shaft 40. The sleeve 30 acts to permit rotation of the hollow steering wheel shaft by use of bearings 42 and 44 which can be in the form of self lubricated bearing sleeves disposed within the annular space 46 between the hollow steering wheel shaft 8 and the sleeve 30.

Within sleeve 30 there is disposed a hydraulic pump shaft 40 which runs coaxial with sleeve 30 and hollow steering wheel shaft 8. The hydraulic pump shaft 40 extends beyond each terminal end of the sleeve 30 and seen at 52 and 54. At each end the horizontal reciprocal or movable hydraulic pump shaft 40 bears against a pair of bearing members 56 and 58 which are in the form of sleeve bearing members made of a resilient material to permit reciprocal movement of the hydraulic pump shaft 40.

At the end of the shaft 40 proximate the steering wheel 2 the hydraulic pump shaft 40 is linkably connected to a lever. This lever 60 is housed within a V-shaped lever connector 62 which pivots about pin 66. Linkage 62, in turn, is pivotally connected at 68 to hydraulic pump shaft 40 whereby movement of shaft 60 will cause a raising or lowering of the hydraulic pump shaft 40.

At its end opposite to lever 60 the hydraulic pump shaft 40 is linkably connected via linkage 70 to an arm 72 of the piston of the hydraulic pump shown generally by reference numeral 74.

In operation the operator can steer the boat by appropriate movement of steering wheel 2 whereby to rotate about the sleeve 30 the steering wheel shaft 8 supported by bearing 75 and to effect movement of the rudder in response thereto owing to the connections provided by the steering sprocket 14 which is in turn connected to the balance of the navigational control which is not shown.

When it is appropriate to raise or lower the centerboard or adjust the backstay the lever 60 is engaged causing reciprocal movement of the hydraulic pump shaft 40 which in turn sends additional fluid to or effects removal of fluid from the hydraulic system by actuation of the hydraulic pump piston having piston arm 72. The net result is that the centerboard 81 on the sailboat 82 is moved by means 83 from the phantom position shown in FIG. 1 to a position whereby the centerboard is retracted in its housing barely visible as viewed from the side or the backstay adjuster 76 increases or decreases tension on the backstay 77. In FIG. 1 it is seen that the steering assembly is located in the normal location of the ship and between the port and starboard sides whereby to facilitate movement of the centerboard. The steering wheel 2 is positioned in a vertical position to allow for horizontal disposition of the hydraulic pump shaft 40. It will be appreciated, however, that the steering wheel 2 can be positioned in a horizontal position whereby actuation of the pump 74 is accomplished by a vertical movement of the hydraulic pump shaft 40.

The actuation of the hydraulic pump feeds additional fluid to and/or returned additional fluid from the hydraulic cylinder lines which are mechanically connected to a cable or a series of cables which, in turn, are connected to the centerboard. The particular mechanical connections between the hydraulic unit and the centerboard or backstay adjuster are not critical to the present invention.

It is apparent that steering can be accomplished by a single operator while at the same time the centerboard can be raised or lowered or the backstay adjusted. Steering is readily facilitated using the steering wheel assembly described whereby they bear against a central sleeve member which in turn carries within its interior the hydraulic pump shaft means which transmits motion from the actuator assembly comprising the parts corresponding to reference numerals 60–68 to the pump itself (parts corresponding to reference numerals 70–74).

What is claimed is:

1. In a steering assembly for navigating a boat having a vertically movable centerboard movable by a hydraulic means including a hydraulic pump whereby to raise or lower said centerboard, said boat having a steering wheel connected to a hollow steering wheel shaft which shaft in turn is connected to a steering sprocket, the improvement for simultaneously raising or lowering the centerboard which comprises a hydraulic pump shaft disposed through said steering wheel shaft, said hydraulic pump shaft connected to an actuating means at said steering wheel and at its opposite end connected to said hydraulic pump.

2. A steering assembly for a boat according to claim 1 wherein disposed within said hollow steering wheel shaft there is a hollow sleeve running coaxially with said hollow steering wheel shaft and said hydraulic pump shaft is contained within said hollow sleeve.

3. A steering assembly for a boat according to claim 2 wherein there is at least one bearing disposed between the outer wall of said sleeve and the inner wall of said hollow steering wheel shaft and there is at least one additional bearing disposed between said hydraulic pump shaft and the inner wall of said sleeve.

4. A steering assembly for a boat according to claim 3 wherin there are a pair of annular bearings disposed between the outer wall of said sleeve and the inner wall of said hollow steering wheel shaft and there are a pair of annular bearings disposed between said hydraulic pump shaft and the inner wall of said sleeve.

5. A steering assembly for a boat according to claim 3 wherein said actuating means comprises a lever linkably connected to the pivotally movable with respect to said hydraulic pump shaft.

6. A steering assembly for a boat according to claim 5 wherein said hydraulic pump shaft is linkably connected to an arm of a piston of said hydraulic pump.

7. A steering assembly according to claim 1 wherein said hydraulic pump is in a hydraulic system including a piston connected to means for raising and lowering a centerboard.

8. A steering assembly according to claim 1 wherein said hydraulic pump is in a first hydraulic system comprising a first piston and means for increasing or decreasing tension on a backstay, and a second system comprising a second piston on means for raising or lowering a centerboard, said systems and said pump interconnected by a valve which allows fluid from said pump to feed only said first or second system

9. In a steering assembly for navigating a boat having an adjustable backstay movable by a hydraulic means including a hydraulic pump whereby to hydraulically adjust a backstay thereon, said boat having a steering wheel connected to a hollow steering wheel shaft which shaft, in turn, is connected to a steering sprocket, the improvement for adjusting said backstay which comprises a hydraulic pump shaft disposed through said steering wheel shaft, said hydraulic pump shaft connected to an actuating means at said steering wheel and at its opposite end connected to said hydraulic pump.

10. A steering assembly according to claim 9 wherein said hydraulic pump is in a hydraulic system including a piston connected to means for increasing or decreasing tension on a backstay of a sailboat whereby to rake the mast.

* * * * *

UNITED STATES PATENT AND TRADEMARK OFFICE

CERTIFICATE OF CORRECTION

PATENT NO. : 3,996,875

DATED : DECEMBER 14, 1976

INVENTOR(S) : MARTENS ISENBERG, Jr.

It is certified that error appears in the above-identified patent and that said Letters Patent are hereby corrected as shown below:

Claim 5, line 3, after "to" (first occurrence) change "the" to -- and --.

Signed and Sealed this

First Day of March 1977

[SEAL]

*Attest:*

RUTH C. MASON
*Attesting Officer*

C. MARSHALL DANN
*Commissioner of Patents and Trademarks*